US005538446A

United States Patent [19]

Diniz et al.

[11] Patent Number: 5,538,446

[45] Date of Patent: Jul. 23, 1996

[54] WEDGE COMPONENT FOR TAPPING CONNECTOR

[75] Inventors: Milton E. Diniz; Esdras Gallo, both of Braganca Paulista, Brazil

[73] Assignee: The Whitaker Corporation, Wilmington, Del.

[21] Appl. No.: 298,806

[22] Filed: Aug. 31, 1994

[30] Foreign Application Priority Data

Sep. 30, 1993 [BR] Brazil ..... MU 730186.2 U

[51] Int. Cl.[6] ..... H01R 4/50

[52] U.S. Cl. ..... 439/783; 211/115 M; 24/136 R

[58] Field of Search ..... 439/783; 24/136 R, 24/115 H, 115 M

[56] References Cited

U.S. PATENT DOCUMENTS 3,280,856 10/1966 Booske et al. ..... 439/783

3,588,791 6/1971 Polidori ..... 439/783

5,244,422 9/1993 Laricchia ..... 439/783

*Primary Examiner*—P. Austin Bradley

*Assistant Examiner*—T. C. Patel

*Attorney, Agent, or Firm*—Timothy J. Aberle

[57] ABSTRACT

A wedge component (1) for an electrical tap connector employed for the connection of conductors (5) of electrical distribution networks. The wedge (1) is generally trapezoidal in shape, can be manufactured of aluminum, and includes a lowering (2) and a reinforcement projection (3) longitudinally extending between side grooves (4,4'). The wedge (1) is lightweight, inexpensive, and strong since the reinforcement projection (3) provides strength for the tap connector wedge component (1) when it is applied to the conductors (5). FIG. 1.

11 Claims, 2 Drawing Sheets

WEDGE COMPONENT FOR TAPPING CONNECTOR

BACKGROUND OF THE INVENTION

The present invention relates to wedge components for tapping connectors comprised of a "C"-shaped component and a wedge, itself generally manufactured by an aluminum alloy, which are employed to connect aluminum or copper conductors, with or without steel core and further solid conductors or those made of two or more conductors of electrical distribution networks. Specifically, the present invention relates to a wedge component for a tapping connector comprising a lighter aluminum wedge, which is cheaper and as resistant as the wedge components of the prior art.

Tapping connectors employed for connecting conductors of electrical distribution networks can be of the screw type, of the compression type or, further, of the wedge type of the prior art.

The screw type tapping connectors have the disadvantage of needing to be periodically readjusted, and the ones of the compression type are difficult to choose for an application and, once being applied cannot be re-used, in addition, when removed from the electrical lines, they render the conductors useless.

Therefore, the tapping connectors comprised of a C-shaped component and a wedge component, which are employed to connect conductors of electrical distribution networks are well accepted in the art since the wedge component for tapping connectors presents such a shape, construction and application which eliminates the above mentioned disadvantages.

However, the wedge components for tapping connector employed until the present date have the disadvantage of being heavy and employing a great deal of raw material in their manufacture since they are solid pieces, which consequently burdens the final cost of the piece.

Accordingly, it is desirable the development of a wedge component for tapping connectors for connecting conductors for electrical distribution networks which is light, resistant and of low manufacturing cost.

SUMMARY OF THE INVENTION

The present invention provides a wedge component for a tapping connector employed for the connection of conductors of electrical distribution networks, comprised of a wedge itself of a generally trapezoid shape, manufactured of aluminum and having in the top and bottom portions, a lowering and a reinforcement projection longitudinally extending along the same.

Since said wedge connector for the tapping connectors is provided of lowerings in both its top and bottom portions, it was possible to obtain a wedge component for a tapping connector which is light, cheaper and resistant since said reinforcement projections have the function of guaranteeing the strength of the tappering connector wedge component when it is applied.

The following detailed description of the preferred embodiment of the present invention will be better understood and additional features of the invention will become apparent when made in connection with the accompanying drawings.

BREIF DESCRIPTION OF THE DRAWINGS

DETAILED DESCRIPTION OF THE INVENTION

Figure 1:
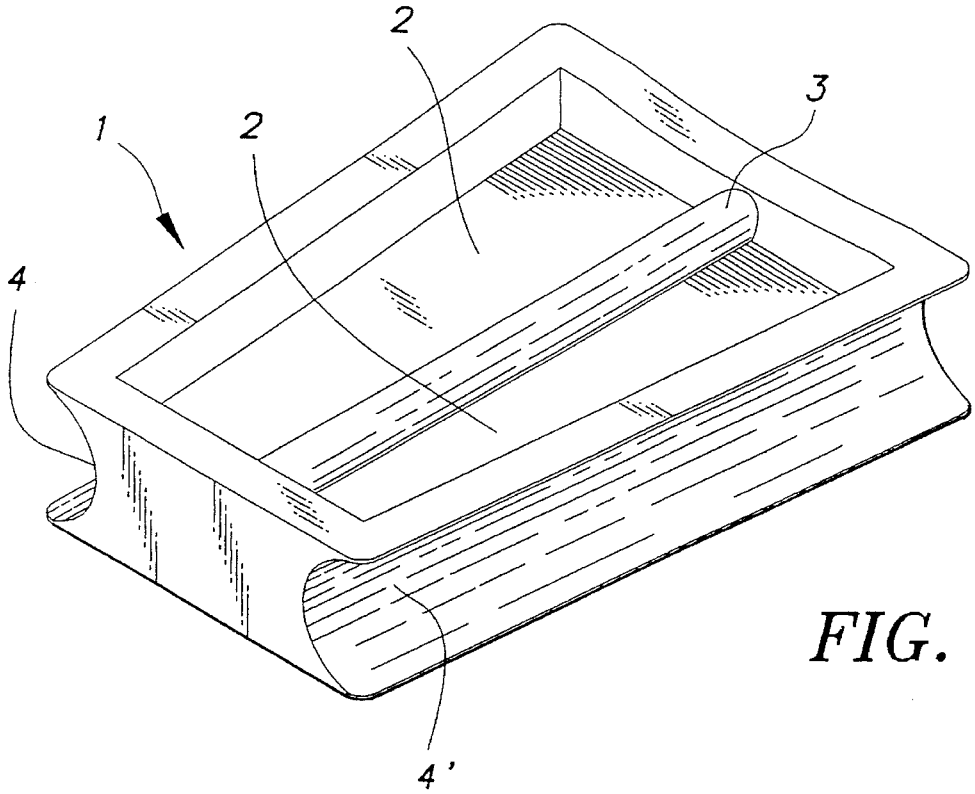
FIG. 1 is a perspective view showing the wedge component for tapping connectors of the present invention.
Figure 6:
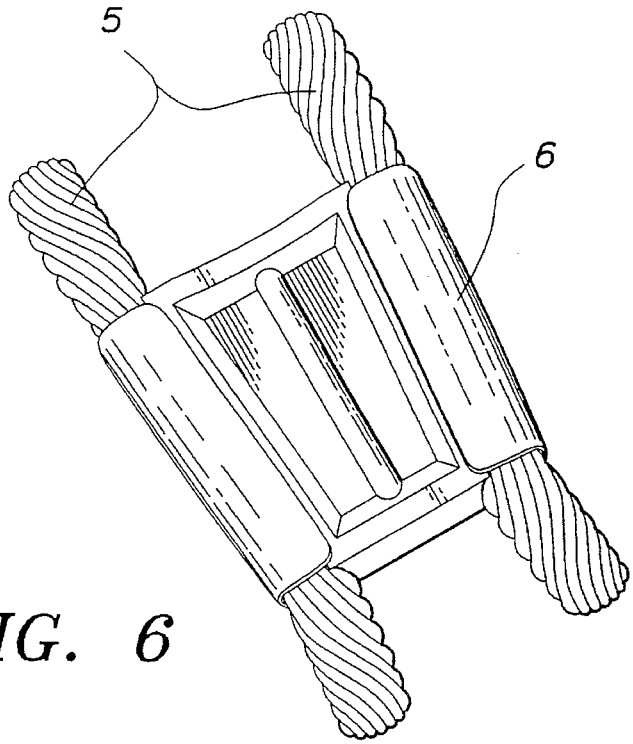
FIG. 6 is a perspective view of a tapping connector assembled with the wedge component of the present invention.
Figure 5:
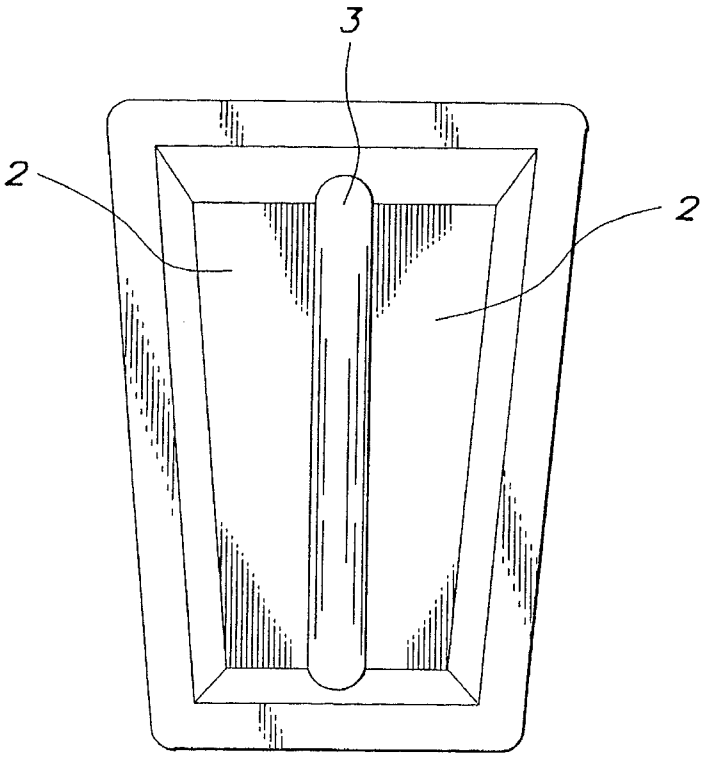
FIG. 5 is a top view of the wedge component for tapping connectors of the present invention. The bottom view of the same was omitted since it is substantially identical to the one of FIG. 5.
Figure 2:
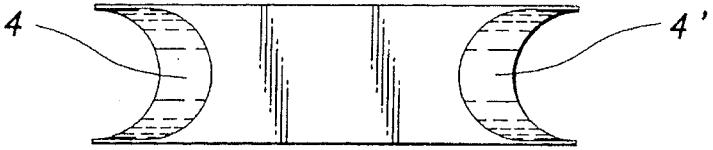
FIG. 2 is a frontal view of the wedge component for tapping connectors of the present invention.
Figure 3:
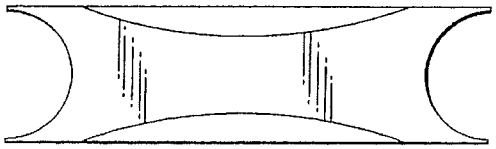
FIG. 3 is a back view of the wedge component for tapping connectors of the present invention.
Figure 4:
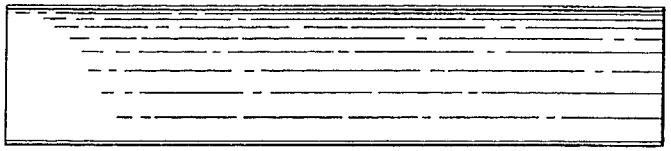
FIG. 4 is a side view, taken from the right side of the object of FIG. 1. The other side view taken from the left side of the object of FIG. 1 was omitted since it is substantially the same as the one illustrated in FIG. 4.

The wedge component 1 for tapping connector employed for connecting conductors 5 of electrical distribution networks of the present invention is preferably manufactured of aluminum, having a generally trapezoid shape and a lowering 2 in its top and bottom portions, which permits economy of raw material, further having a reinforcement projection 3 longitudinally extending along the top and bottom portions of the wedge component for connector guaranteeing the same strength of the solid wedges of the prior art.

The wedge component 1 for tapping connector, further having side grooves 4,4' to accommodate conductors 5.

The application of the wedge component 1 for tapping connector 6 in the conductors 5 is very simple. First, a "C" component, well known in the art, is placed in a way that the main conductor and the tapping be duly positioned. Next, the wedge component 1 for connector 6 is placed between the conductors 5. Then, a tool for application of connectors (of the type described and claimed in Brazilian patent application PI 9303375, filed on Aug. 13, 1993 by the same Applicant of the present application), after being loaded, is positioned and secured to the connector.

Completing the connection, the wedge component 1 for connector 6 is placed between conductors 5 already positioned in the "C" component. The spring action of C-component carried out from outside to inside maintains a uniform and constant permanent contact between the connector 6 and conductors 5.

At the end of the application a lock is automatically formed at the end portion of the wedge component 1 for connector 6, which guarantees its positioning.

Thus, when employing the wedge component 1 for tapping connectors 6 of the present invention it is obtained connections of two connectors 5 in a fraction of time quite a bit smaller than the time necessary to install conventional connectors and with the advantage of employing a connector which is lighter, cheaper, more resistant and of similar performance as the connectors of the prior art.

Although the invention has been shown and described with respect to a best mode embodiment thereof, it should be understood by those skilled in the art that the foregoing and various other changes, omissions and additions in the form and detail thereof may be made therein without departing from the spirit and scope of the invention as claimed in the appended claims.

We claim:

1. A wedge member for use with an electrical tap line connector for an electrical system, comprising:

a wedge member having at least one side groove therein for accommodating a conductor of an electrical system; and said wedge member includes a lowered portion in a surface thereof with a reinforcement projection in said lowered portion, and said reinforcement projection comprises a section thereof having a longitudinal axis, and said section axis is generally aligned with a longitudinal axis of said groove for transmitting forces along said section longitudinal axis.

2. The wedge member of claim 1, wherein said lowered portion comprises a transverse back surface which is relatively longer than a transverse front surface of said lowered portion, and said reinforcement projection is operative to support said front surface when said wedge member is installed.

3. The wedge member of claim 1, wherein said lowered portion comprises a transverse back surface which is relatively longer than a transverse front surface of said lowered portion, and said front and back surfaces extend away from said lowered portion for being supported by said reinforcement projection when said wedge member is installed.

4. The wedge member of claim 1, wherein said lowered portion comprises a transverse back surface which is relatively longer than a transverse front surface of said lowered portion, and said reinforcement projection is operative to support said back surface when said wedge member is installed.

5. The wedge member of claim 4, wherein said back surface is generally transverse relative to said section longitudinal axis for transmitting forces along said projection longitudinal axis.

6. A wedge member for use with an electrical tap line connector for an electrical system, comprising:

a wedge member having at least two axially directed sides therein for accommodating conductors of an electrical system; and said wedge member includes a lowered portion in a surface thereof with an axially directed reinforcement means for axially stiffening said wedge member in said lowered portion.

7. The wedge member of claim 6, wherein said reinforcement means comprises a section thereof having a longitudinal axis, and said section axis is generally aligned with a longitudinal axis of at least one of said sides for transmitting forces along said projection longitudinal axis.

8. The wedge member of claim 6, wherein said lowered portion comprises a transverse back surface which is relatively longer than a transverse front surface of said lowered portion, and said reinforcement means is operative to support said front surface when said wedge member is installed.

9. The wedge member of claim 6, wherein said lowered portion comprises a transverse back surface which is relatively longer than a transverse front surface of said lowered portion, and said front and back surfaces extend away from said lowered portion for being supported by said reinforcement means when said wedge member is installed.

10. The wedge member of claim 6, wherein said lowered portion comprises a transverse back surface which is relatively longer than a transverse front surface of said lowered portion, and said reinforcement means is operative to support said back surface when said wedge member is installed.

11. The wedge member of claim 10, wherein said reinforcement means comprises a section thereof having a longitudinal axis, and said back surface is generally transverse relative to said section longitudinal axis for transmitting forces along said reinforcement means longitudinal axis.

* * * * *